US006362442B1

(12) United States Patent
Engel et al.

(10) Patent No.: US 6,362,442 B1
(45) Date of Patent: Mar. 26, 2002

(54) TWO-STAGE SELF ADJUSTING TRIP LATCH

(75) Inventors: Edward I. Engel, Grove City, FL (US); Oceola W. Fugate, Middletown, OH (US)

(73) Assignee: Square D Company, Palatine, IL (US)

( * ) Notice: Subject to any disclaimer, the term of this patent is extended or adjusted under 35 U.S.C. 154(b) by 0 days.

(21) Appl. No.: 09/476,053

(22) Filed: Dec. 31, 1999

(51) Int. Cl.[7] ..... H01K 5/00
(52) U.S. Cl. ..... 200/400; 218/154
(58) Field of Search ..... 200/17 R, 400, 200/401, 500, 501, 318, 321–326; 218/7, 14, 78, 84, 92, 120, 140, 153, 154

(56) References Cited

U.S. PATENT DOCUMENTS

| | | | | |
|---|---|---|---|---|
| 3,593,235 | A | 7/1971 | Nicol | 335/186 |
| 3,604,300 | A | 9/1971 | Allison | 83/76 |
| 3,614,362 | A | 10/1971 | Keranen | 200/167 A |
| 3,624,333 | A | 11/1971 | Schurr | 200/166 SD |
| 3,632,936 | A | 1/1972 | Piber | 200/157 |
| 3,636,286 | A | 1/1972 | Hutts | 200/68 |
| 3,644,793 | A | 2/1972 | Ilk | 317/141 S |
| 3,646,355 | A | 2/1972 | Ireland et al. | 307/64 |
| 3,680,016 | A | 7/1972 | Becker et al. | 335/106 |
| 3,711,669 | A | 1/1973 | Keranen | 200/167 A |
| 3,720,797 | A | 3/1973 | Gunn et al. | 200/61.08 |
| 3,726,494 | A | 4/1973 | Flagg et al. | 244/3.14 |
| 3,740,741 | A | 6/1973 | Jones | 340/272 |
| 3,742,402 | A | 6/1973 | Nicol et al. | 335/13 |
| 3,742,403 | A | 6/1973 | Nicol | 335/13 |
| 3,787,654 | A | 1/1974 | Rys | 200/170 A |
| 3,805,115 | A | 4/1974 | Heckelman | 317/80 |
| 3,809,840 | A | 5/1974 | Schurr | 200/321 |
| 3,838,355 | A | 9/1974 | Papaieck | 331/39 |
| 3,875,360 | A | 4/1975 | Rys | 200/153 SC |
| 3,876,847 | A | 4/1975 | Dykes et al. | 200/153 SC |
| 3,879,589 | A | 4/1975 | Rys | 200/50 A |
| 3,881,077 | A | 4/1975 | Piber | 200/61.69 |
| 3,891,862 | A | 6/1975 | Clark | 307/125 |
| 3,895,198 | A | 7/1975 | Piber | 200/61.62 |
| 3,967,132 | A | 6/1976 | Takamine | 290/4 R |
| 4,001,683 | A | 1/1977 | McNeilly | 324/115 |
| 4,002,874 | A | 1/1977 | Brown | 200/321 |
| 4,041,260 | A | 8/1977 | Swindler et al. | 200/50 A |
| 4,095,065 | A * | 6/1978 | Akers | 200/63 R |
| 4,110,585 | A | 8/1978 | Brown | 200/305 |
| 4,121,065 | A | 10/1978 | Woodard | 200/42 T |
| 4,121,069 | A | 10/1978 | Long | 200/67 A |
| 4,146,765 | A * | 3/1979 | Wilson | 200/153 SC |
| 4,154,997 | A | 5/1979 | Grebner et al. | 200/159 R |
| 4,166,935 | A | 9/1979 | Norby | 200/72 R |
| 4,177,389 | A | 12/1979 | Schott | 307/64 |
| 4,218,602 | A | 8/1980 | Creech | 200/302 |

(List continued on next page.)

OTHER PUBLICATIONS

Eaton Catalog, Oct. 1998, Cutler–Hammer—G–14 Safety Switches Heavy Duty Double Throw, Fusible, Non–Fusible; Discount Symbol 22CD; Cat. 73.01.T.E.

*Primary Examiner*—Michael Friedhofer
(74) *Attorney, Agent, or Firm*—David R. Stacey; Larry T. Shrout; Larry I. Golden

(57) ABSTRACT

A trip latch in a switch housing having an open position and reset-stop position comprising a force member for providing a force to the trip latch. The trip latch also has a primary trip shaft having a first end rotatably connected at opposed first and second ends in the front and rear frame, and a reductor arm extending therefrom. The trip latch further includes a secondary trip shaft rotatably connected at opposed ends to the front and rear frames of the housing proximate and substantially parallel to the primary trip shaft such that the reductor arm engages a bottom portion of the secondary trip shaft. The secondary trip shaft is shaped such that when the secondary trip shaft is rotated the reductor arm may rotate past the secondary trip shaft, thereby causing the trip latch to open.

18 Claims, 5 Drawing Sheets

U.S. PATENT DOCUMENTS

| | | | | | |
|---|---|---|---|---|---|
| 4,267,711 | A | | 5/1981 | Kolze | 68/12 R |
| 4,324,963 | A | * | 4/1982 | Maier et al. | 200/318 |
| 4,335,287 | A | | 6/1982 | Aschenbach et al. | 200/302 |
| 4,337,450 | A | | 6/1982 | Matthies | 337/66 |
| 4,370,528 | A | | 1/1983 | Aschenbach | 200/6 BB |
| 4,454,398 | A | | 6/1984 | Aschenbach et al. | 200/302.3 |
| RE31,634 | E | | 7/1984 | Norby | 200/72 R |
| 4,490,694 | A | | 12/1984 | Godbout | 333/104 |
| 4,517,717 | A | | 5/1985 | Gentry | 29/6 |
| 4,525,697 | A | | 6/1985 | Jones et al. | 337/354 |
| 4,544,810 | A | | 10/1985 | Butterworth | 200/5 B |
| 4,559,971 | A | | 12/1985 | Bradshaw | 137/596.17 |
| 4,736,081 | A | | 4/1988 | Sorrells | 200/160 |
| 4,788,618 | A | | 11/1988 | Kimura | 361/86 |
| 4,791,255 | A | | 12/1988 | Eliezer | 200/144 R |
| 4,866,221 | A | | 9/1989 | Obermann et al. | 200/5 R |
| 4,908,553 | A | | 3/1990 | Hoppie et al. | 318/382 |
| 4,934,492 | A | | 6/1990 | Hayes-Sheen | 188/353 |
| 5,005,382 | A | | 4/1991 | Duve | 68/12.16 |
| 5,045,648 | A | | 9/1991 | Fogleman, Sr. | 200/43.16 |
| 5,052,424 | A | | 10/1991 | Zerndt et al. | 137/1 |
| 5,117,189 | A | | 5/1992 | Terminiello et al. | 324/415 |
| 5,149,998 | A | | 9/1992 | Wolcott | 310/105 |
| 5,157,383 | A | | 10/1992 | Fisher | 340/574 |
| 5,216,396 | A | | 6/1993 | Stahly | 335/80 |
| 5,262,679 | A | | 11/1993 | Schweitzer, III et al. | 307/127 |
| 5,308,957 | A | | 5/1994 | Huffington | 219/483 |
| 5,355,024 | A | | 10/1994 | Elliott et al. | 307/73 |
| 5,397,868 | A | | 3/1995 | Smith et al. | 200/18 |
| 5,436,415 | A | | 7/1995 | Smith et al. | 200/50 C |
| 5,486,978 | A | | 1/1996 | Fishovitz | 361/617 |
| 5,488,211 | A | * | 1/1996 | Castonguay et al. | 200/400 |
| 5,542,513 | A | | 8/1996 | Reyes | 192/9 |
| 5,612,580 | A | | 3/1997 | Janonis et al. | 307/64 |
| 5,642,002 | A | | 6/1997 | Mekanik et al. | 307/64 |
| 5,735,179 | A | | 4/1998 | Edwards, Jr. et al. | 74/553 |
| 5,739,488 | A | | 4/1998 | Cassity et al. | 200/17 R |
| 5,777,283 | A | | 7/1998 | Greer | 200/18 |
| 6,064,021 | A | * | 5/2000 | Wehrli et al. | 200/400 |
| 6,087,610 | A | * | 7/2000 | Castonguay et al. | 218/154 |

* cited by examiner

TWO-STAGE SELF ADJUSTING TRIP LATCH

TECHNICAL FIELD

The present invention generally relates to a trip latch for use with high current switches for circuit breakers, and more particularly relates to a trip latch having a primary and a secondary trip shaft for reducing the load required for opening.

BACKGROUND OF THE INVENTION

Switches are used in circuit breakers and switchboards to disconnect and distribute power for commercial and industrial applications. During operation, the need often arises to trip the switches to prevent, explosions, fires or potential damage to downstream equipment. Typically, the switches are fitted with trip latches that cause the switch to trip and open under a predetermined load generated by a current signal.

High current switches typically require large operating forces to insure opening under the predetermined load. Trip latches in such high current switches may require loads of between 20 to 25 pounds to reliably trip the switches. Among the problems presented by generating loads of this magnitude is having to provide larger transformers having larger solenoids. Accordingly, there is a need for an effective and efficient means to reduce the loads necessary to trip high current switches.

The present invention is provided to solve these and other problems and to provide other advantages. A preferred embodiment will be disclosed, and the novel aspects of the present invention will be particularly identified and discussed herein.

SUMMARY OF THE INVENTION

It is an object of the present invention to provide a two-stage trip latch for high current switches and circuit breakers.

According to the present invention, the trip latch having an open position and reset-stop position is disposed within a switch housing. The trip latch has a force member for providing a force to a primary trip shaft. The primary trip shaft has a first end rotatably connected at opposed first and second ends in the front and rear frame, and a reductor arm extending therefrom. The trip latch further includes a secondary trip shaft rotatably connected at opposed ends to the front and rear frames of the housing proximate and substantially parallel to the primary trip shalt such that the reductor arm engages a bottom portion of the secondary trip shaft. The secondary trip shaft is shaped such that when the secondary trip shaft is rotated the reductor arm may rotate past the secondary trip shaft, thereby causing the trip latch to open.

According to another aspect of the invention, the force member is a rotatable opening crank, wherein the opening crank has a first end and a second end. The first end is attached to a compressible spring to provide a rotating force and the second end of the opening crank has a latch step for engaging the primary trip shaft.

According to another aspect of the invention, the force member is a linear moving member having a first and second end. Again, the first end is attached to a compressible spring to provide a force and the second end engages the primary trip shaft.

Other features and advantages of the invention will be apparent from the following specification taken in conjunction with the following drawings.

BRIEF DESCRIPTION OF THE DRAWINGS

In order that the present invention may be more fully understood, it will now be described by way of example, with reference to the accompanying drawings in which.

DETAILED DESCRIPTION OF THE PREFERRED EMBODIMENT

Figure 1:
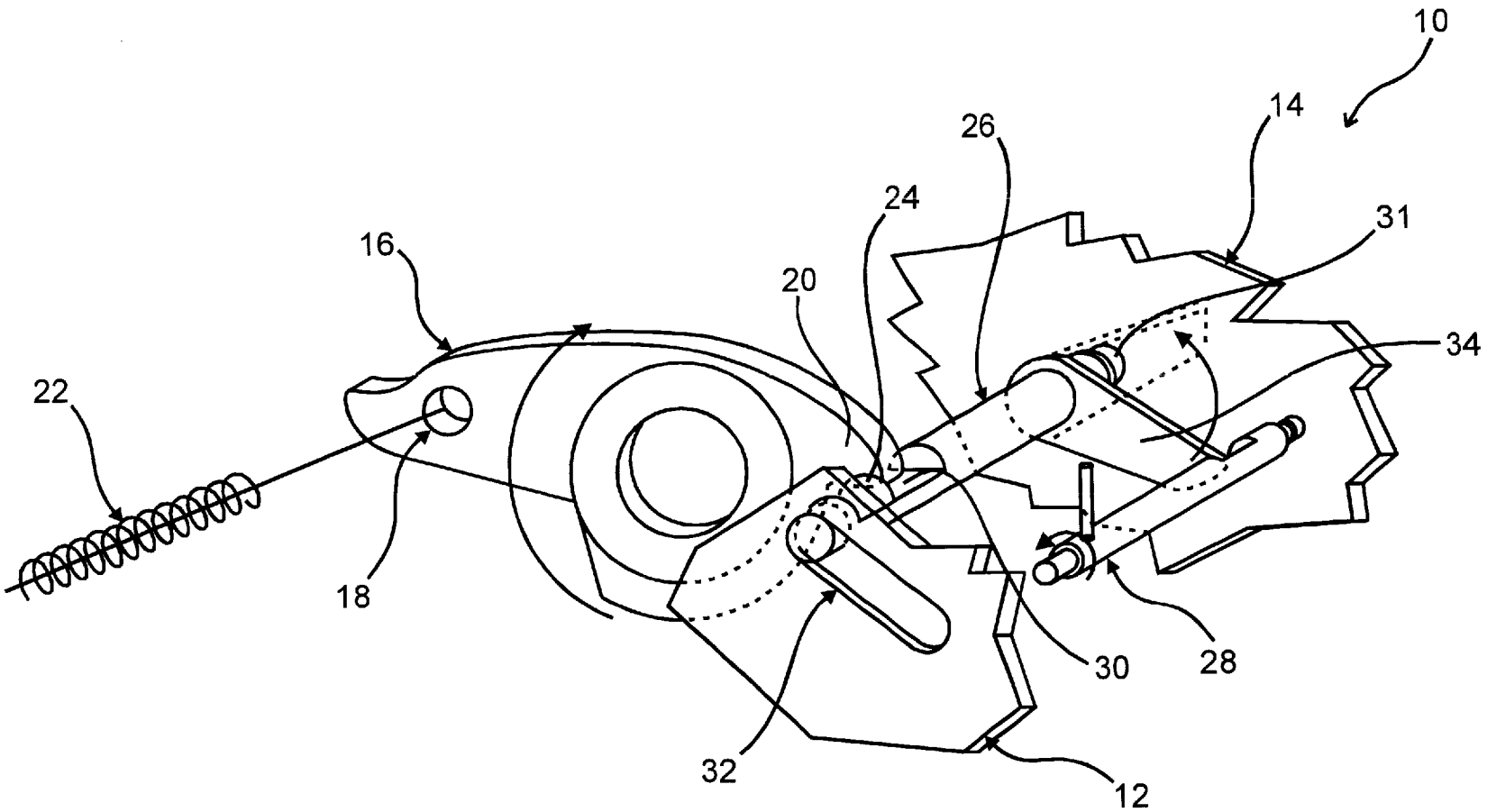
FIG. 1 is a perspective view of a two-stage self-adjusting trip latch according to the present invention.
Figure 2:
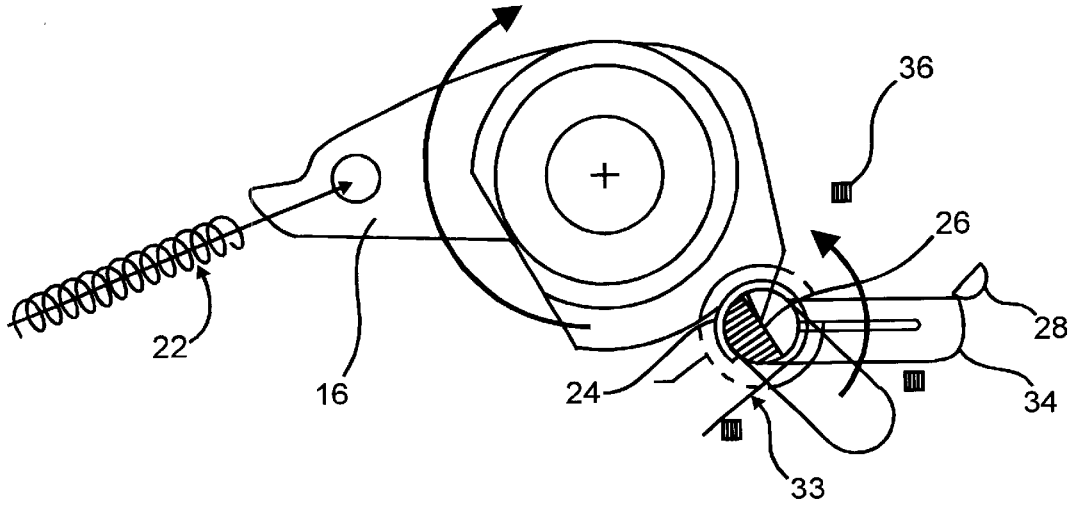
FIG. 2 is a side view of a two-stage self-adjusting trip latch according to the present invention illustrating the trip latch prior to opening.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated or described.

FIG. 1 illustrates a perspective view ova two-stage self-adjusting, trip latch 10 for high-current switches and circuit breakers. The trip latch 10 of the present invention has an open position and reset-stop position. Generally, the switch or circuit breaker in which the trip latch 10 is disposed has a housing with a front frame 12 and a rear frame 14.

Figure 5:
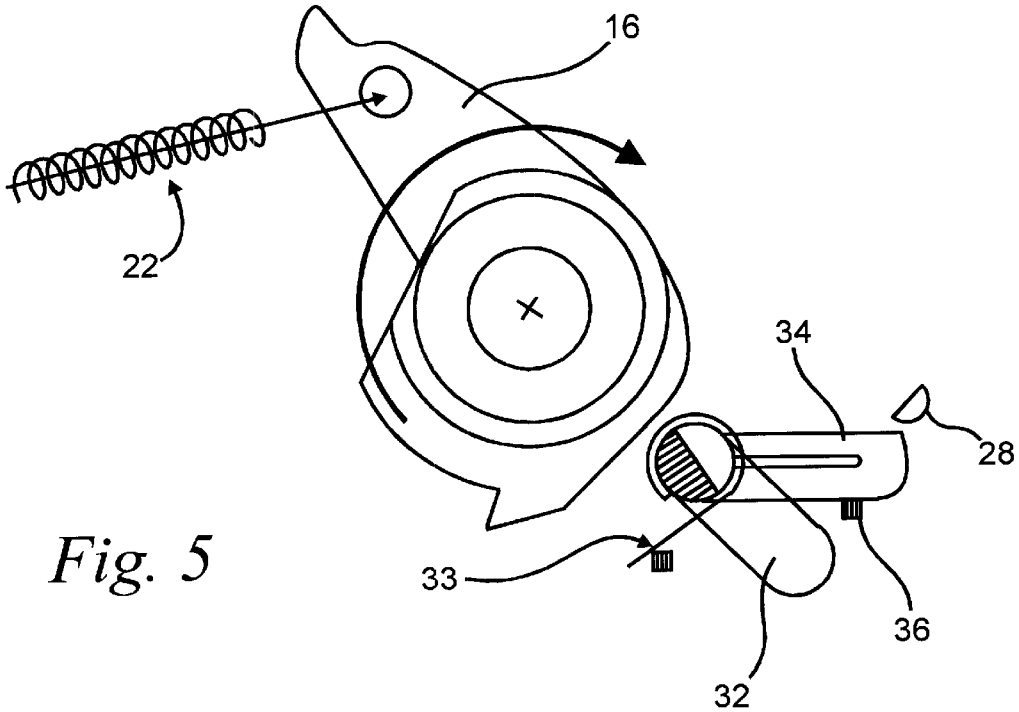
FIG. 5 is a side view of a two-stage self-adjusting trip latch according to the present invention illustrating the trip latch, wherein the primary trip shaft is released and the switch is open; and, FIG. 6 is a side view of a two-stage self-adjusting trip latch according to the present invention illustrating the trip latch being charged and reset; and, FIG. 7 is a perspective view of a two-stage self-adjusting trip latch with a linear moving member according to the present invention.
Figure 6:
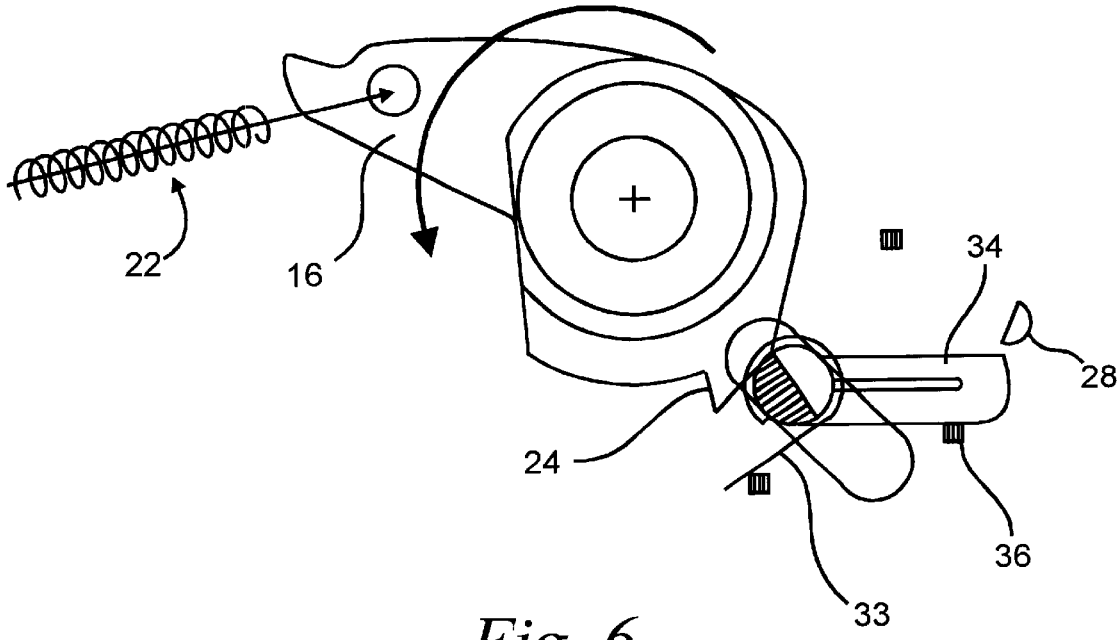
Figure 7:
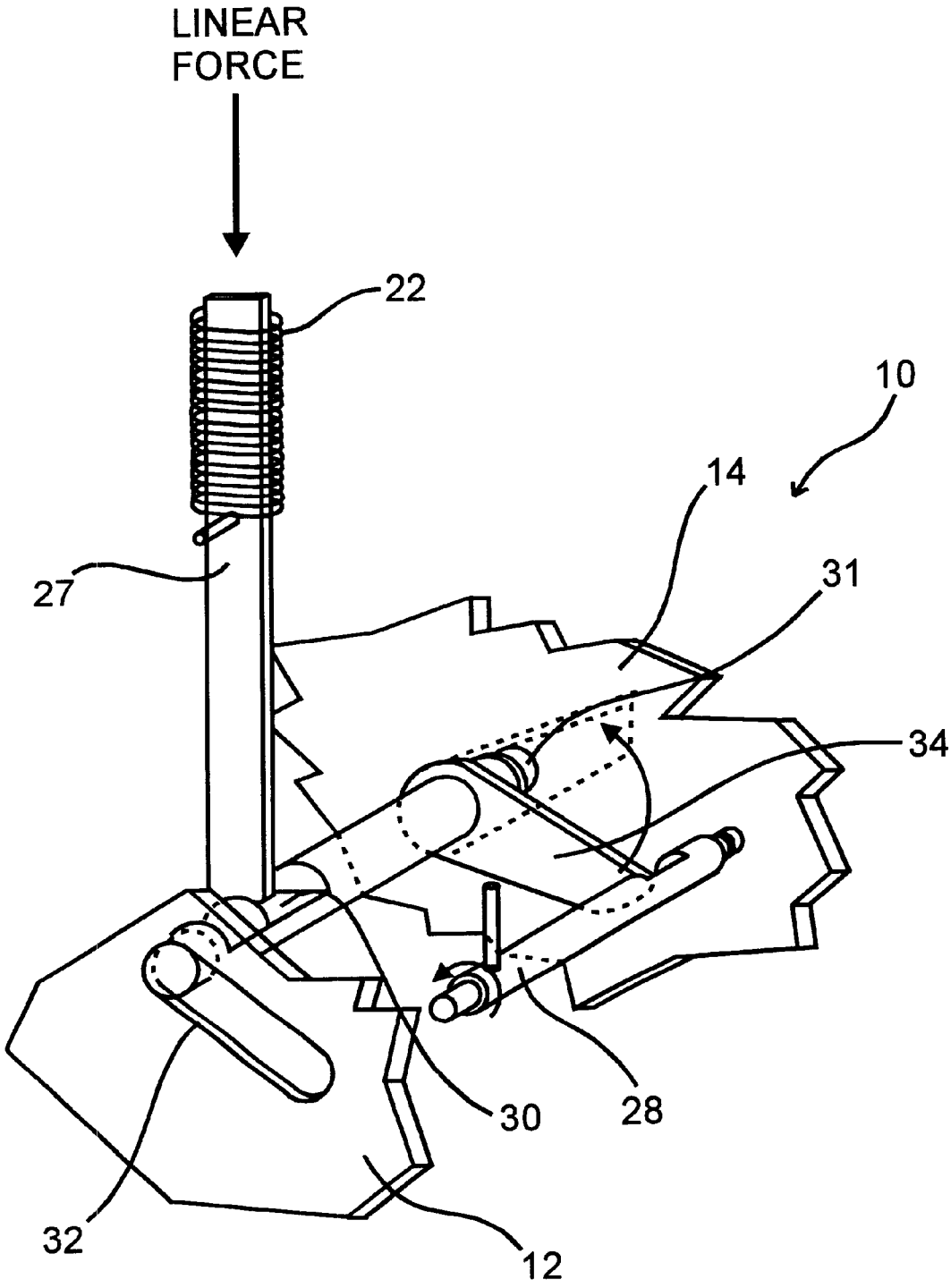

The trip latch 10 generally includes a rotatable opening crank 16 having a first end 18 and a second end 20. The first end 18 of the opening crank 16 is attached to an element 22 that is compressible to provide a rotating force, and the second end 20 of the opening crank 16 has a latch step 24 for engaging a primary trip shaft 26. Typically, the element 22 that provides the force is a compression spring; however, it is contemplated that the element 22 can be any device capable of providing a force to the opening crank 16. Furthermore, while the embodiment depicted in FIGS. 1–6 illustrates an opening crank 16 providing a rotating force, the present invention could also employ a linear moving member 27, providing a linear force to the primary trip shaft 26, as shown in FIG. 7. The trip latch 10 also has a primary trip shaft 26 and a secondary trip shaft 28.

The primary trip shaft 26 has a first end rotatably inserted in an opening 31 in the rear frame 14 and a second end rotatably and slidably inserted into a radial slot 32 in the front frame 12. At least a portion of the second end 30 of the primary trip shaft 26 is substantially flat for engaging the latch step 24 of the opening crank 16. The second end 20 of the primary trip shaft 26 is connected to a biasing element 33. The biasing element 33 provides a torsional bias to force the primary trip shaft 26 toward the reset-stop position and provides linear bias to move the flat portion of the second end 30 toward the opening crank 16. The primary trip shaft 26 also has a reductor arm 34 extending therefrom.

The secondary trip shaft 28 is rotatably attached at opposed ends to the front and rear frames 12,14 of the housing proximate and substantially parallel to the primary trip shaft 26. The primary trip shaft 26 is biased such that the reductor arm 34 engages a bottom portion of the secondary trip shaft 28. The secondary trip shaft 28 has a substantially flat portion such that when the secondary trip shaft 28 is rotated, the reductor arm 34 of the primary trip shalt 26 may rotate past the secondary trip shaft 28, thereby opening the trip latch 10.

Figure 3:
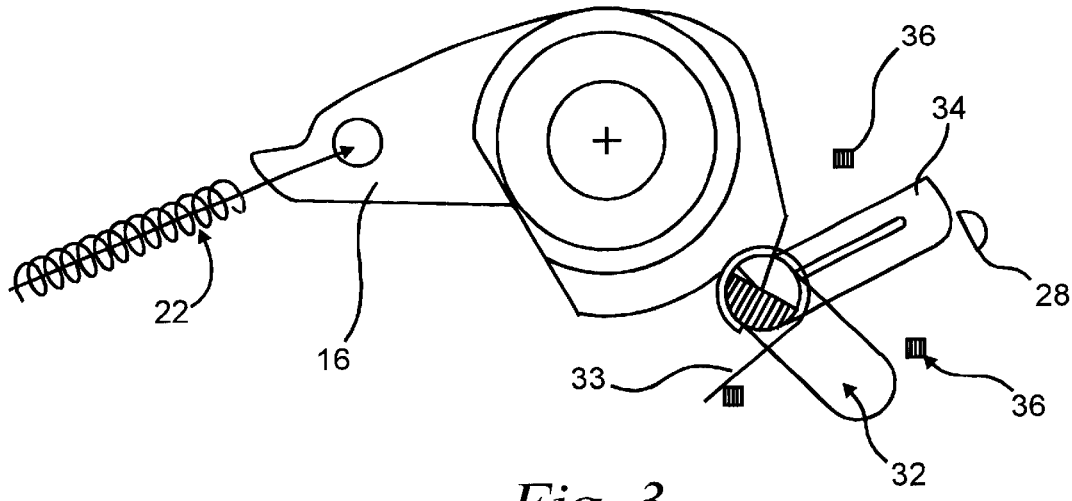
FIG. 3 is a side view of a two-stage self-adjusting trip latch according to the present invention illustrating the trip latch, wherein the secondary trip shaft is released.
Figure 4:
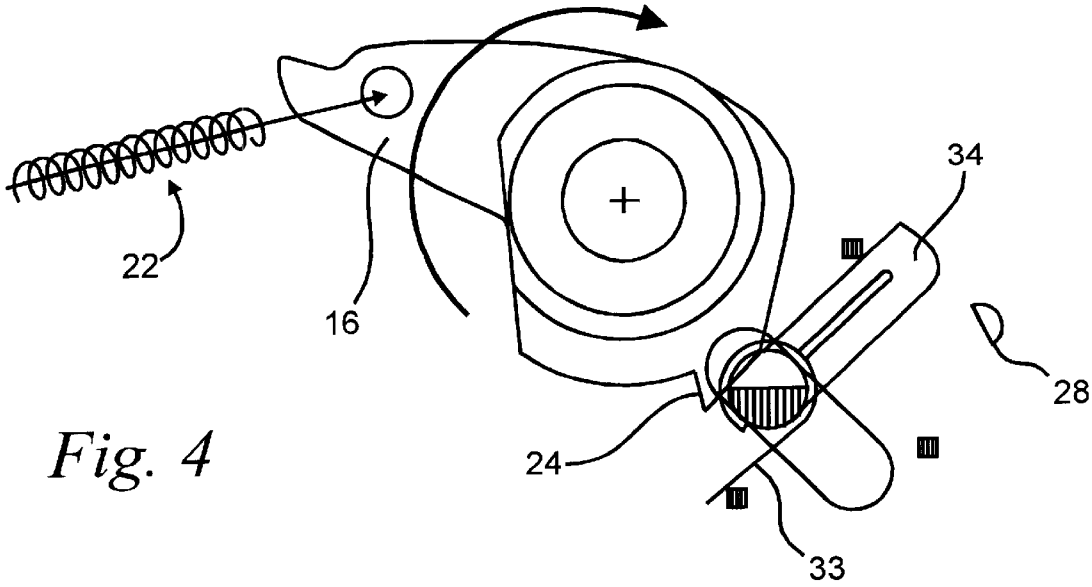
FIG. 4 is a side view of a two-stage self-adjusting trip latch according to the present invention illustrating the trip latch, wherein the primary trip shaft is released and the switch is partially opened.

In operation, the trip latch 10 can be electronically tripped by a fault powered system. However, it is contemplated that the present trip latch 10 can also be tripped by a self powered trip system or some other more conventional means. As can be seen in FIG. 3, when the trip latch 10 is tripped, the secondary trip shaft 28 is rotated counter-clockwise such that the tip of the reductor arm 34 of the primary trip shaft 26 is released. As shown in FIGS. 3–5, the primary trip shaft 26 then rotates counter-clockwise until the radial force of the opening crank 16 against the flat portion of the primary trip shaft 26 exceeds the reset spring bias along the slot 32. As this force overcomes the bias of the reset spring, the slot guided end of the primary trip shaft 26 moves along the slot 32 away from the opening crank 16. Thus, the primary trip shaft 26 is released, and thereby allowed to rotate clockwise and open the switch.

As best seen in FIG. 5, once the latch step 24 of the opening crank 16 passes the primary trip shaft 26 during the opening operation, the primary trip shaft 26 reset spring rotates the primary trip shaft 26 clockwise and moves the slot-guided end of the primary trip shaft 26 back toward the opening crank 16 to reset the trip latch 10. As shown in FIGS. 2–6, the trip latch 10 includes a plurality of fixed members 36 positioned within the housing. The fixed members 36 limit the rotation of the reductor arm 34 of the primary trip shaft 26 to prevent over-travel of the reductor arm 34. The fixed members 36 can be pegs, projections or any other protrusions capable of retarding the rotation of the reductor arm 34.

To reset the trip latch 10, the compressible spring connected to the opening crank 16 must be recharged or re-compressed. As illustrated in FIG. 6, this is accomplished by manually rotating the opening crank 16 counter-clockwise. The back surface of the opening crank 16 latch step 24 cams the slot-guided end of the primary trip shaft 26 away. When the opening crank 16 latch step 24 passes the edge of the flat portion of the primary trip shaft 26, the reset spring moves the slot-guided end of the primary trip shaft 26 back to the latched position against the opening crank 16. When the spring charging is complete, the opening spring rotates the opening crank 16 clockwise to bear on the flat portion of the primary trip shaft 26. The primary trip shaft 26 then rotates counter-clockwise from the reset stop position until the reductor 34 is again rested against the secondary trip shaft 28.

While the specific embodiment has been illustrated and described, numerous modifications come to mind without significantly departing from the spirit of the invention, and the scope of protection is only limited by the scope of the accompanying Claims.

We claim:

1. In a housing for a switch having a front frame and a rear frame, a trip latch having an open position and reset-stop position comprising:

a force member for providing a force;

a primary trip shaft rotatably connected at opposed first and second ends to the front and rear frame, the primary trip shaft further having a reductor arm extending therefrom, the primary trip shaft receiving the force provided by the force member; and, a secondary trip shaft rotatably connected at opposed ends to the front and rear frames of the housing proximate and substantially parallel to the primary trip shaft such that the reductor arm engages a bottom portion of the secondary trip shaft, the secondary trip shaft being shaped such that when the secondary trip shaft is rotated the reductor arm can rotate past the secondary trip shaft, thereby causing the trip latch to move to the open position.

2. The trip latch of claim 1 wherein the force member is a rotatable opening crank.

3. The trip latch of claim 2 wherein the opening crank has a first end and a second end, the first end being attached to an element that is compressible to provide a rotating force, the second end having a latch step for engaging the primary trip shaft.

4. The trip latch of claim 1 wherein the force member is a linearly moving member.

5. The trip latch of claim 4 wherein the linearly moving member has a first end and a second end the first end being attached to an element that is compressible to provide a force, the second end having a latch step for engaging the primary trip shaft.

6. The trip latch of claim 1 wherein the first end of the primary trip shaft is rotatably inserted in an opening in the rear frame and the second end of the primary trip shaft is rotatably and slidably inserted into a radial slot in the front frame, and wherein the second end is connected to a biasing element that provides a torsional bias to force the primary trip shaft toward the reset-stop position and provides linear bias to move the second end of the primary trip shaft toward the force member.

7. The trip latch of claim 1 wherein the biasing element is a torsion spring.

8. The trip latch of claim 1 further including a plurality of fixed members positioned within the housing for limiting the rotation of the reductor arm.

9. In a housing for a switch having a front frame and a rear frame, a trip latch having an open position and reset-stop position comprising:

a force member for providing a force;

a primary trip shaft having a first end rotatably inserted in an opening in the rear frame and a second end rotatably and slidably inserted into a radial slot in the front frame, wherein the second end of the primary trip shaft engages the force member and the second end is connected to a biasing element that provides a torsional bias to force the primary trip shaft toward the reset-stop position and provides linear bias to move the second end of the primary trip shaft toward the force member, the primary trip shaft further having a reductor arm extending therefrom;

a secondary trip shaft rotatably attached at opposed ends to the front and rear frames of the housing proximate and substantially parallel to the primary trip shaft, the primary trip shaft being biased such that the reductor arm engages a bottom portion of the secondary trip shaft, the secondary trip shaft being shaped such that when the secondary trip shaft is rotated, the reductor arm can rotate past the secondary trip shaft, thereby causing the trip latch to move to the open position.

10. The trip latch of claim 9 wherein the force member is a rotatable opening crank.

11. The trip latch of claim 10 wherein the opening crank has a first end and a second end, the first end being attached to an element that is compressible to provide a rotating force, the second end having a latch step for engaging the primary trip shaft.

12. The trip latch of claim 9 wherein the force member is a linearly moving member.

13. The trip latch of claim 12 wherein the linearly moving member a first end and a second end, the first end being attached to an element that is compressible to provide a force, the second end having a latch step for engaging the primary trip shaft.

14. The trip latch of claim 9 wherein the biasing element is a torsion spring.

15. The trip latch of claim 9 further including a plurality of fixed members positioned within the housing for limiting the rotation of the reductor arm.

16. In a housing for a switch having a front frame and a rear frame, a trip latch having an open position and reset-stop position comprising:

a rotatable opening crank having a first end and a second end, the first end being attached to an element that is compressible to provide a rotating force to a primary trip shaft, the second end of the opening crank having a latch step;

a primary trip shaft having a first end rotatably inserted in an opening in the rear frame and a second end rotatably and slidably inserted into a radial slot in the front frame, wherein at least a portion of the second end of the primary trip shaft is substantially flat for engaging the latch step of the opening crank and the second end is connected to a biasing element that provides a torsional bias to force the primary trip shaft toward the reset-stop position and provides linear bias to move the flat portion of the second end toward the opening crank, the primary trip shaft further having a reductor arm extending therefrom;

a plurality of fixed members positioned within the housing for limiting the rotation of the reductor arm; and, a secondary trip shaft rotatably attached at opposed ends to the front and rear frames of the housing proximate and substantially parallel to the primary trip shaft, the primary trip shaft being biased such that the reductor arm engages a bottom portion of the secondary trip shaft, the secondary trip shaft having a substantially flat portion such that when the secondary trip shaft is rotated, the reductor arm of the primary trip shaft can rotate past the secondary trip shaft, thereby causing the trip latch to move to the open position.

17. The trip latch of claim 16 wherein the compressible element is a spring.

18. The trip latch of claim 17 wherein the biasing element is a torsion spring.

* * * * *